US006068209A

United States Patent [19]

Nakamura

[11] Patent Number: 6,068,209

[45] Date of Patent: May 30, 2000

[54] SHEET PAY-OUT DEVICE AND SHEET ROLL FOR THE SAME

[75] Inventor: Jun Nakamura, Tokyo-to, Japan

[73] Assignee: Riso Kagaku Corp., Tokyo, Japan

[21] Appl. No.: 08/151,694

[22] Filed: Nov. 15, 1993

[30] Foreign Application Priority Data

Nov. 13, 1992 [JP] Japan ..... 4-304011

[51] Int. Cl.[7] ..... B65H 23/06; B65H 18/28; B65H 26/00

[52] U.S. Cl. ..... 242/421.2; 242/160.1; 242/563.2; 242/912; 33/733

[58] Field of Search ..... 242/333.5, 333.2, 242/421, 160.1, 357, 534.2, 412.3, 421.2, 563.2, 912, 413.2, 334.5; 226/37, 38, 45; 33/732, 733, 751

[56] References Cited

U.S. PATENT DOCUMENTS 1,935,970 11/1933 Wooster et al. ..... 242/563.2 X 4,199,118 4/1980 Tetro et al. ..... 242/421.2 X 4,848,698 7/1989 Newell et al. ..... 242/912 X

*Primary Examiner*—John Q. Nguyen

*Attorney, Agent, or Firm*—Dickstein Shapiro Morin & Oshinsky LLP

[57] ABSTRACT

In a sheet pay-out device for paying out a sheet from a sheet roll, the sheet roll is subjected to a rotational resistance which increases with the diminishing outer diameter of the sheet roll as the sheet is paid out therefrom so that the tension acting upon the sheet may be kept at a substantially constant level over the entire length of the sheet, and a favorable feeding action for the sheet is ensured. The information on the current outer diameter of the sheet roll is preferably printed on the sheet as an optical code. This device is suitable for use as a stencil master plate sheet feeding unit of a stencil printer equipped with the function of making stencil master plates, for feeding a stencil master plate sheet from a sheet roll.

14 Claims, 7 Drawing Sheets

SHEET PAY-OUT DEVICE AND SHEET ROLL FOR THE SAME

TECHNICAL FIELD

The present invention relates to a sheet pay-out device for feeding a sheet from a roll, and a sheet roll suitable for use with such a device. The present invention particularly relates to a sheet pay-out device which can apply a tension to the sheet as it is fed from a roll, and a sheet roll suitable for use with such a device.

BACKGROUND OF THE INVENTION

Sheet pay-out devices for feeding a sheet from a sheet roll are widely used in various devices and machines that handle flexible sheets. For instance, in a stencil printing device provided with the function of making stencil master plates, a sheet pay-out device is used in a master plate sheet supply unit for feeding a stencil master plate sheet from a stencil master plate sheet roll wound around a central core.

In such a sheet pay-out device, it is often necessary to apply a tension to the sheet so that the sheet may be paid out from the sheet roll without slacking or creasing. Typically, in such a stencil printing device, a frictional resistance is applied to the sheet by pressing a sheet spring upon a flange at one end of the roll or upon a retainer for the flange.

In such a sheet pay-out device, there are two conflicting requirements. One is to avoid slacking or creasing of the sheet. The other is to avoid stretching the sheet. To achieve an acceptable solution, it is necessary to control the tension applied to the sheet.

In particular, because a stencil master plate sheet consisting of a thermoplastic resin film for thermal plate making based on selective perforation is highly flexible and thin, it can easily slack, crease and stretch. If a stencil master plate becomes either slack, creased or stretched, a stable printed image cannot be obtained. It is therefore necessary to appropriately control the tension applied to the stencil master plate sheet.

When a frictional resistance is applied to the rotation of a sheet roll as a back torque for the purpose of applying a tension to the sheet, the tension acting upon the sheet is given by dividing this back torque by the radius of the roll. Therefore, if the frictional resistance acting upon the rotation of the roll is fixed, the tension changes as the sheet is paid out from the roll, and the diameter of the roll diminishes. For instance, if the initial radius of the roll is 45 mm, and the final radius of the roll is 22.5 mm, and if the frictional resistance or the back torque acting upon the rotation of the roll is fixed, the tension acting upon the sheet increases by the factor of two from the initial condition to the final condition.

Therefore, in such a situation, it was conventionally necessary, to the end of ensuring a stable feeding movement of the sheet, to limit the feeding speed of the sheet to a low level, or to provide extra means for preventing the creasing and stretching of the sheet.

BRIEF SUMMARY OF THE INVENTION

In view of such problems of the prior art, a primary object of the present invention is to provide a sheet pay-out device which can apply an appropriate tension to the sheet irrespective of the change in the outer diameter of the sheet roll.

A second object of the present invention is to provide a sheet pay-out device which can pay out a sheet from a sheet roll at high speed without creating creases and elongations in the sheet.

A third object of the present invention is to provide a sheet pay-out device which is suitable for feeding a stencil master plate sheet from a sheet roll in a stencil printer equipped with the function of making stencil master plates.

A fourth object of the present invention is to provide a sheet roll which is suitable for use with such a sheet pay-out device.

These and other objects can be accomplished by providing a sheet pay-out device for paying out a sheet from a sheet roll, comprising support means for rotatably supporting a sheet roll; rotational resistance applying means for applying a variable resistance to a rotation of the sheet roll; roll diameter detecting means for detecting an outer diameter of the sheet roll; and control means for changing the variable resistance according to a change in the outer diameter of the sheet roll detected by the roll diameter detecting means.

Thus, the current outer diameter of the sheet roll can be detected by the outer diameter detecting means on a real time basis, and the resistance to the rotation of the sheet roll produced by the rotational resistance applying means can be appropriately reduced according to the detected outer diameter of the sheet roll as it diminishes, so that the tension of the sheet can be maintained at an appropriate level which is typically a constant value. The rotational resistance could be applied to the sheet roll in a number of ways besides those depending on friction. For instance, among other possibilities, viscous damping, fluid flow resistance and electromagnetic force can be used for the same purpose.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
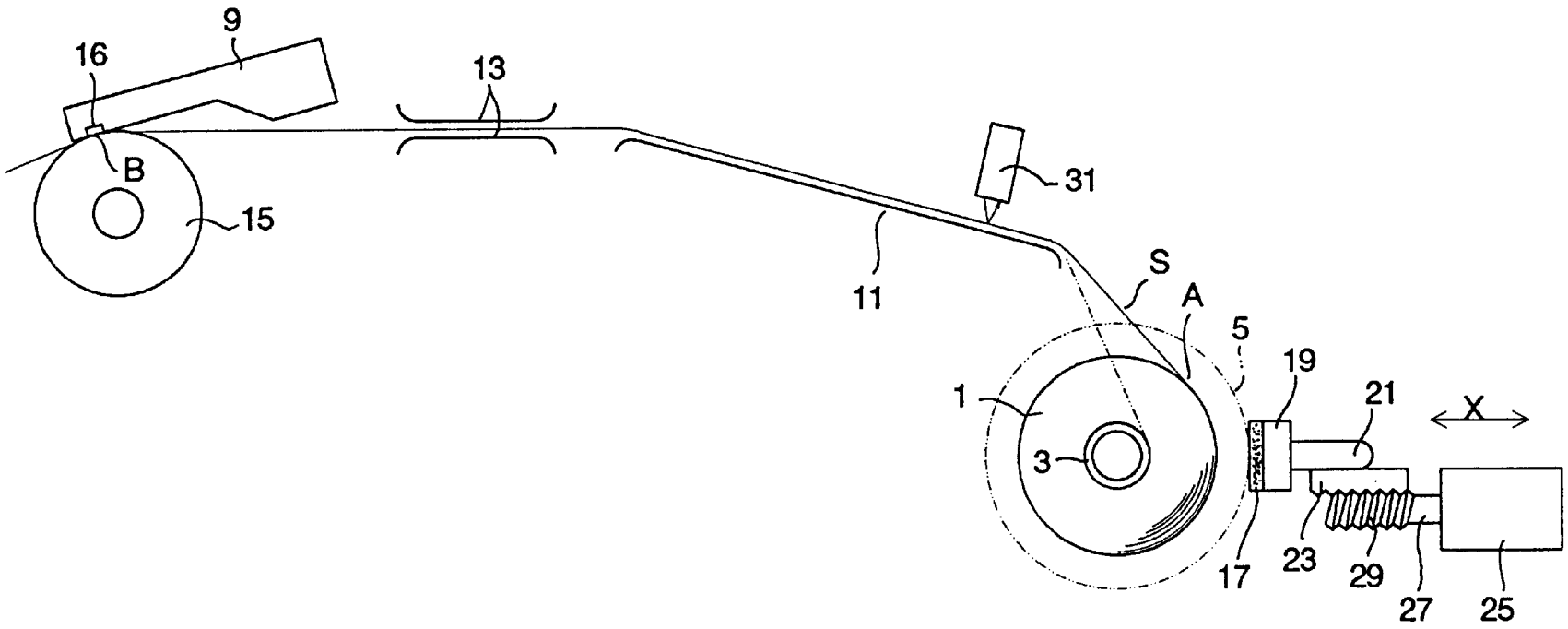
FIG. 1 is a schematic side view of an essential part of an embodiment of the sheet pay-out device according to the present invention as applied to a stencil master plate sheet feeding unit of a stencil printer equipped with the function of making stencil master plates, for feeding a stencil master plate sheet from a sheet roll.

FIG. 1 shows an embodiment of the sheet pay-out device according to the present invention as applied to a stencil master plate sheet feeding unit of a stencil printer equipped with the function of making stencil master plates, for feeding a stencil master plate sheet from a sheet roll.

The sheet roll 1 of a stencil master plate sheet S comprises a core tube 3 around which the continuous stencil master plate sheet S is wound, and a pair of flanges 5 are securely attached to either axial end of the core tube 3 by fitting a central projection 5*a* of each of the flanges 5 into the corresponding end of the core tube 3. Each of the flanges 5 is further provided with a central axial projection 7 (FIG. 2) by which the entire sheet roll assembly may be rotatably supported around its central axial line.

The stencil master plate sheet S is adapted to be thermally perforated, and consists of a laminated assembly of thermoplastic film and a porous support sheet such as Japanese paper which are bonded together by an adhesive agent. Typically, the stencil master plate sheet S has a thickness of approximately 40 $\mu$m, a bending rigidity of 0.01 to 0.05 g-cm, and an elastic modulus of $10^4$ to $10^5$, and is highly flexible and expandable.

Between the mounting position for the sheet roll 1 and a thermal head 9 for plate making is disposed a stencil master plate sheet guide plates 11 and 13 for guiding the stencil master plate sheet S from the sheet roll 1 to the thermal head 9. A platen roller 15 is disposed opposite to the thermal head 9, and the stencil master plate sheet S is pressed against an array of heat generating elements 16 of the thermal head 9 by the platen roller 15 and fed out from the sheet roll 1 as the platen roller 15 is rotated in counter clockwise direction as seen in FIG. 1. As well known in the art, by selective activation of the heat generating elements 16, a desired pattern of perforations are formed in the stencil master plate sheet S. For satisfactory feeding movement of the stencil master plate sheet S, a suitable tension must be applied to the span of the stencil master plate sheet S between the point A of departure from the sheet roll 1 to the nip B between the thermal head 9 and the platen roller 15.

Figure 2:
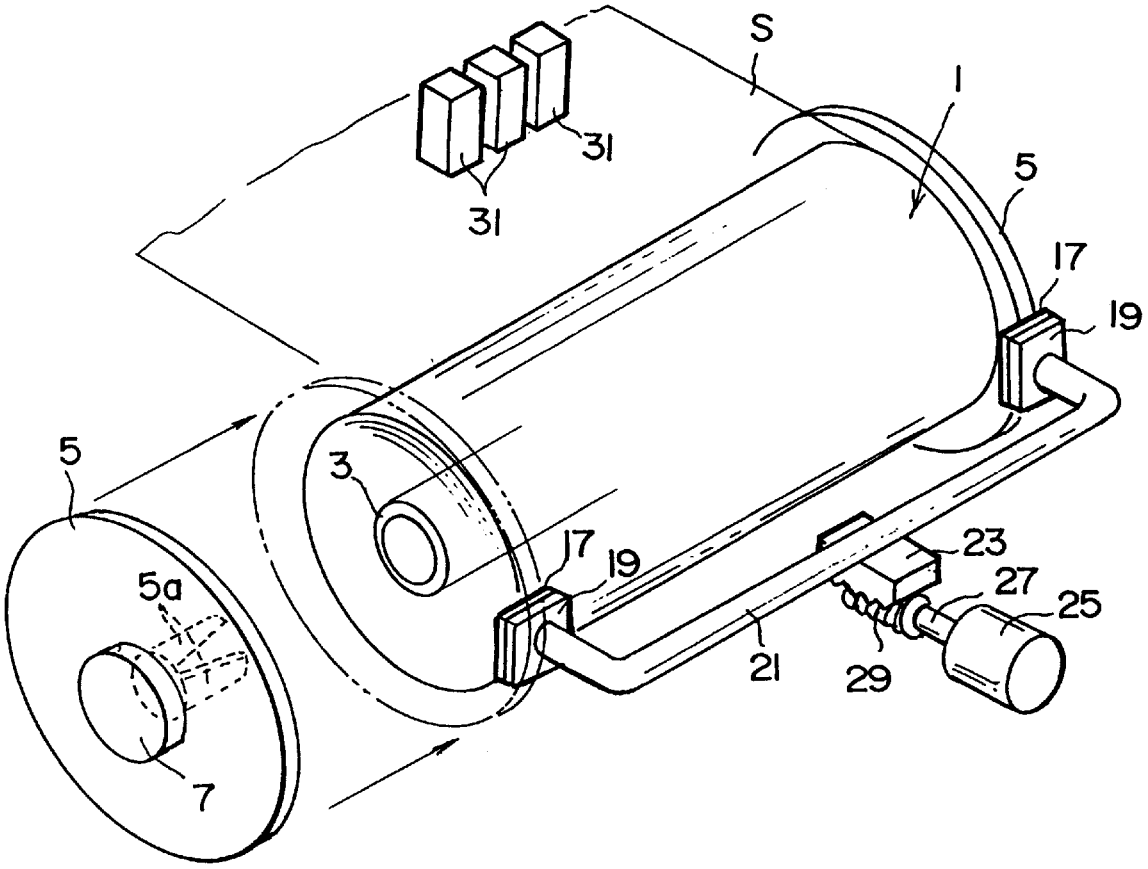
FIG. 2 is a perspective view of the sheet pay-out device according to the present invention.

Referring to FIG. 2, a resistance pad 17 serving as rotational resistance applying means is pressed against the outer circumferential surface of each of the flanges 5 provided on either end of the sheet roll 1. The friction between the flanges 5 and the resistance pads 17 causes a resistance or more specifically a resistance torque to be produced against the rotation of the sheet roll 1. This resistance depends on the pressure by which the resistance pads 17 are applied to the flanges 5.

The resistance pads 17 are supported by corresponding pad support members 19 which are joined together by a lateral connecting member 21. The lateral connecting member 21 is in turn moveably supported by means not shown in the drawing so as to be moveable in the radial direction of the flange members 5 or in the direction indicated by letter X in FIG. 1.

A worm rack 23 is fixedly secured to the lateral connecting member 21, and a worm 29 mounted on an output shaft 27 of an electric motor 25 meshes with the worm rack 23 so that the lateral connecting member 21 can move in the direction indicated by the arrow X in FIG. 1 as the electric motor 25 is actuated in the corresponding direction.

Figure 3:
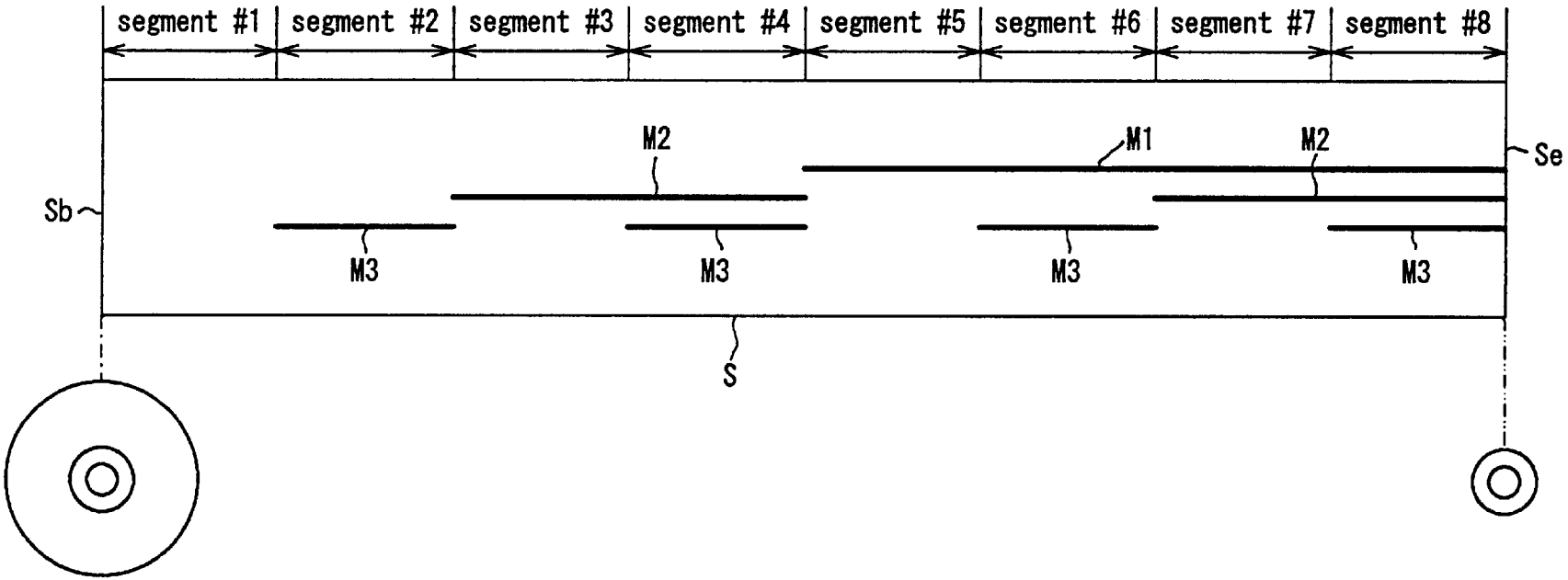
FIG. 3 is a developed view of the sheet paid out from the sheet roll.

Referring to FIG. 3, the stencil master plate sheet S is divided into a plurality of, in this case eight segments along its lengthwise direction between its leading edge Sb and trailing edge Se, and these segments are individually indicated by a set of coded markers. These markers consist of lengthwise parallel lines M1 through M3 which selectively extend along three laterally different positions on the stencil master plate sheet S, and can serve as a carrier of information on the outer diameter of the sheet roll 1.

The outer diameter of the sheet roll 1 depends on which of the segments is being paid out, and there is a prescribed relationship between the outer diameter of the sheet roll 1 and the particular segment that is being paid out. This relationship is dictated mainly by the thickness of the stencil master plate sheet S, and can be experimentally determined. As can be readily understood from FIG. 3, there are eight ($2^3$) different combinations of the markers M1 through M3, which therefore allows identification eight different segments. Obviously, by increasing the number of lengthwise lines to n, the possible combinations can be increased to $2^n$.

These markers M1 through M3 do not affect the function or performance of the stencil master plate sheet S, and may be printed by offset printing, ink jet printing or the like, for instance, when the stencil master plate sheet S is wound into each individual sheet roll from a large stock roll of stencil master plate sheet.

In an appropriate location along the path of conveying the stencil master plate sheet S from the sheet roll 1 to the thermal head 9, three photoelectric sensors 31 serve as diameter detecting means are arranged along the lateral direction, in this embodiment, above the guide plate 11. The three sensors 31 are arranged laterally, and associated with the corresponding markers M1 to M3. The output from the sensors 31 can be considered as a three-bit signal, and can distinguish the eight segments or determine the lengthwise position of the stencil master plate sheet S by eight different levels as given in Table 1.

TABLE 1

| resistance torque | N1 | N2 | N3 | N4 | N5 | N6 | N7 | N8 |
|---|---|---|---|---|---|---|---|---|
| segment # | 1 | 2 | 3 | 4 | 5 | 6 | 7 | 8 |
| mark M1 | 0 | 0 | 0 | 0 | 1 | 1 | 1 | 1 |
| mark M2 | 0 | 0 | 1 | 1 | 0 | 0 | 1 | 1 |
| mark M3 | 0 | 1 | 0 | 1 | 0 | 1 | 0 | 1 |

Figure 4:
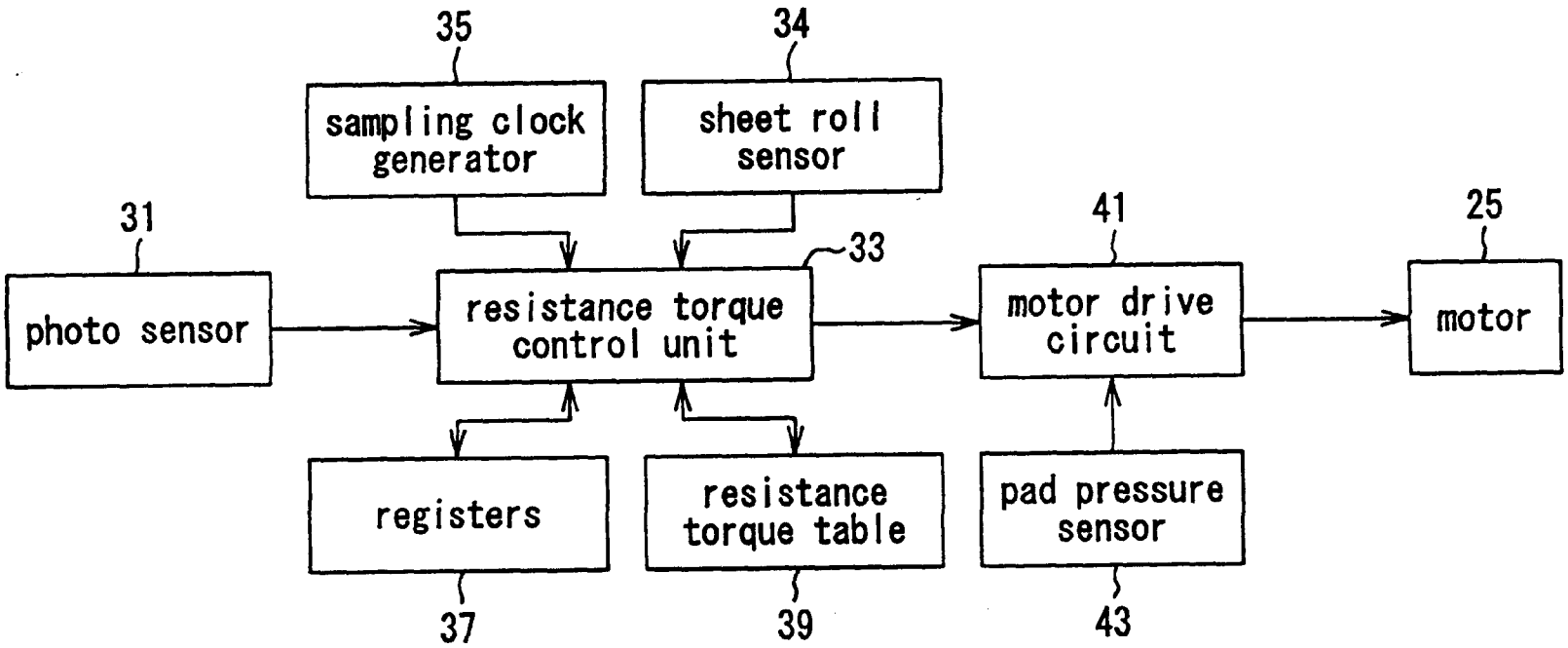
FIG. 4 is a block diagram showing an embodiment of the control unit for the sheet pay-out device according to the present invention.

FIG. 4 shows the control system for the motor 25. The resistance torque control unit 33 reads a three-bit signal R(n) from the three photoelectric sensors 31 according to a timing determined by a sampling clock signal n generated from a sampling clock generator 35, provided that the resistance torque control unit 33 is receiving a signal from a sheet roll sensor 34 indicating that a sheet roll 1 is properly mounted, and writes the three-bit signal in a register circuit 37 as three three-bit binary values R0, R1, and R2. When the three three-bit binary values R0, R1, and R2 are all identical, one of a plurality of signals N1, N2, N3, . . . stored in a resistance torque value memory 39 as a resistance torque table (Table 1), corresponding to the three-bit signal R(n) stored in the register circuit 37, is read by the resistance torque control unit 33, and supplies a corresponding motor drive current command signal to a motor drive circuit 41.

The motor drive circuit 41 receives the motor drive current command signal from the resistance torque control unit 33 as a target value, and a pad pressure signal from a pad pressure sensing unit 43 as a feedback signal, and controls the electric current supplied to the motor 25 according to the deviation between these two signals. In this embodiment, the larger the electric current supplied to the motor is, the greater the pressure of the resistance pads 17 is.

The pad pressure sensing unit 43 may detect the load of the motor 25 as an indication of the pad pressure or may consist of an electric strain gauge provided in the resistance pads 17.

If the radius of the flange 5 is Rf, the coefficient of dynamic friction is $\mu_p$, and the pressure of the friction pads 17 is Fp, the resistance torque N is given by the following equation.

$$N=\mu_p \cdot Fp \cdot Rf \quad (1)$$

If the outer radius of the sheet roll 1 is Rr, the tension applied to the stencil master plate sheet S as it is paid out from the sheet roll 1 is given by the following equation.

$$T=N/Rr \quad (2)$$

Therefore, if the resistance torque N, or, in other words, the pressure Fp of the resistance pads 17 is reduced as the outer radius Rr of the sheet roll 1 diminishes, the tension T acting upon the stencil master plate sheet S may be kept at a constant level.

Based on this consideration, the resistance torque values N1, N2, N3, . . . in the resistance torque table stored in the resistance torque memory 39 are given so that the resistance torque values N1, N2, N3, . . . diminish as the stencil master plate sheet S is paid out or as the outer radius of the sheet roll 1 diminishes.

Figure 5:
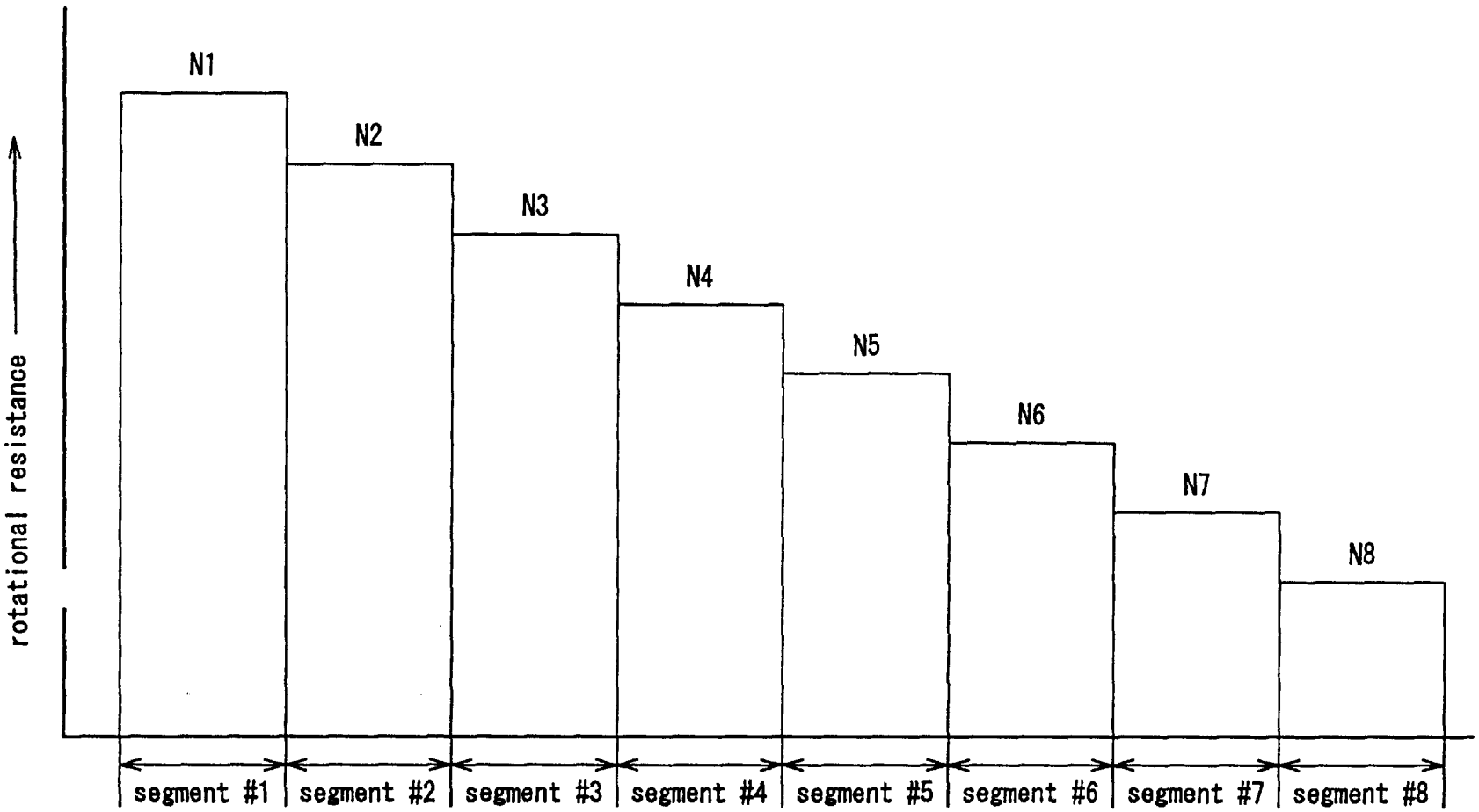
FIG. 5 is a graph showing the relationship between the resistance torque and the different segments of the sheet.
Figure 6:
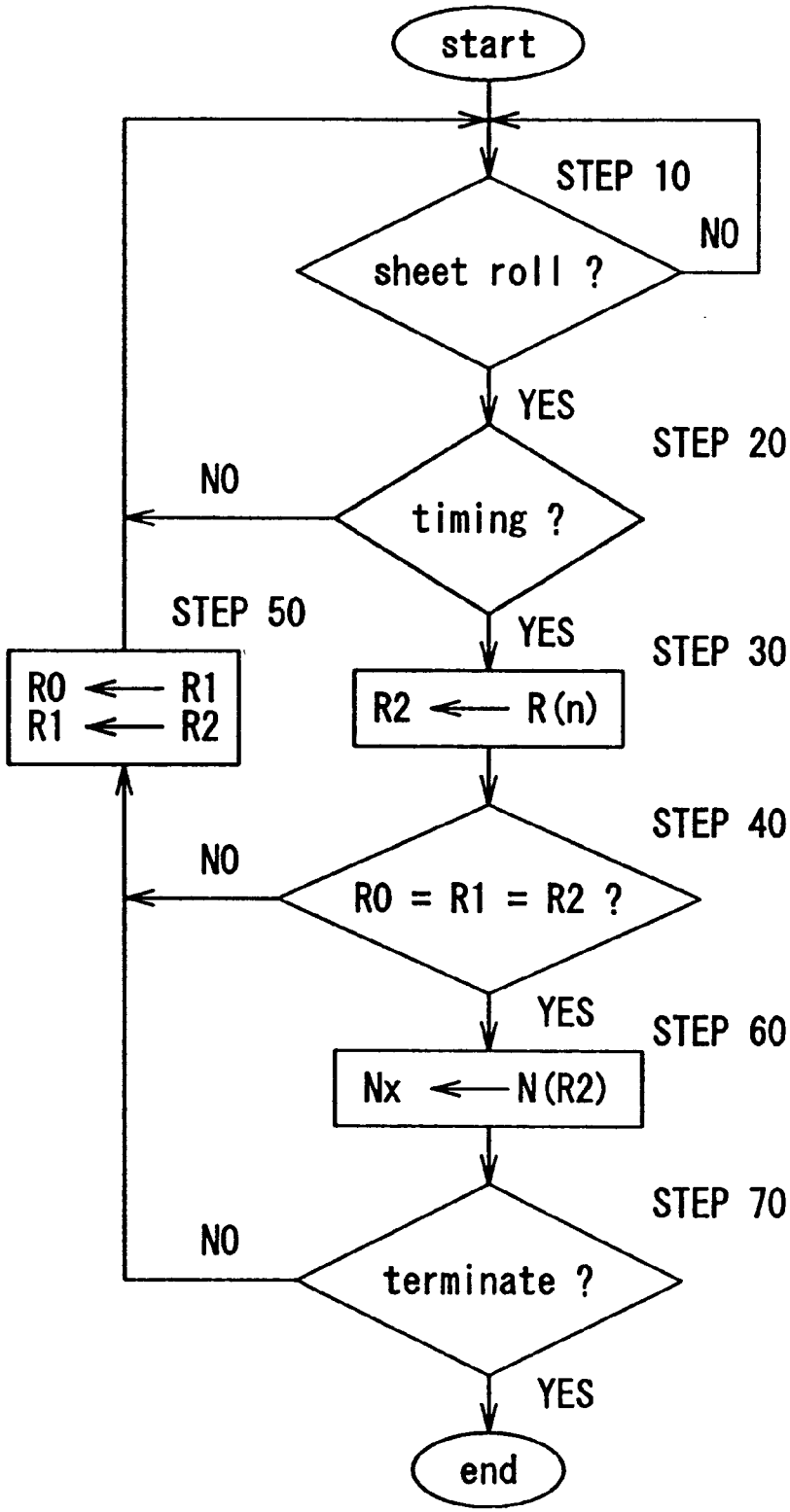
FIG. 6 is a flow chart showing an embodiment of the control flow for controlling the resistance torque in the sheet pay-out device according to the present invention.

FIG. 6 shows the control flow illustrating the operation of the control system shown in FIG. 5. In this control flow, first of all, it is determined if the signal from the sheet roll sensor 34 is indicting that a sheet roll 1 is properly mounted in step 10. If a sheet roll 1 is properly mounted, the resistance torque control unit 33 reads a three-bit signal R(n) from the three photoelectric sensors 31 according to a timing determined by a sampling clock signal n generated from a sampling clock generating circuit 35, and writes it into the register circuit 37 as a three-bit register value R2 (steps 20 and 30).

It is then determined if the three three-bit register values R0, R1 and R2 stored in the register circuit 37 are not identical to each other, the three three-bit register values R0 and R1 are updated by values R1 and R2, respectively (step 50). If the three three-bit register values R0, R1 and R2 stored in the register circuit 37 are not identical to each other, one of the resistance value N1, . . . , N8 corresponding to the three-bit register values is read from the resistance torque table, and supplies a corresponding motor drive current value command signal to the motor drive circuit 41 (step 60). If no terminate signal is issued (step 70), the control flow advances to step 50 for renewal of the register.

By executing such a resistance torque control process, the pressure of the resistance pads 17 are reduced according to the progress from segment #1 to segment #8 of the sheet roll 1 or as the outer radius of the sheet roll 1 diminishes, and the tension of the stencil master plate sheet S can be controlled to a substantially fixed level without regard to the change in the outer radius of the sheet roll 1.

The resistance torque value is renewed only when the three three-bit register values in the register circuit 37 are identical to each other in the above described control flow so that any error due to the transition at each break in any one of the three marks printed on the stencil master plate sheet S may be avoided.

Figure 7:
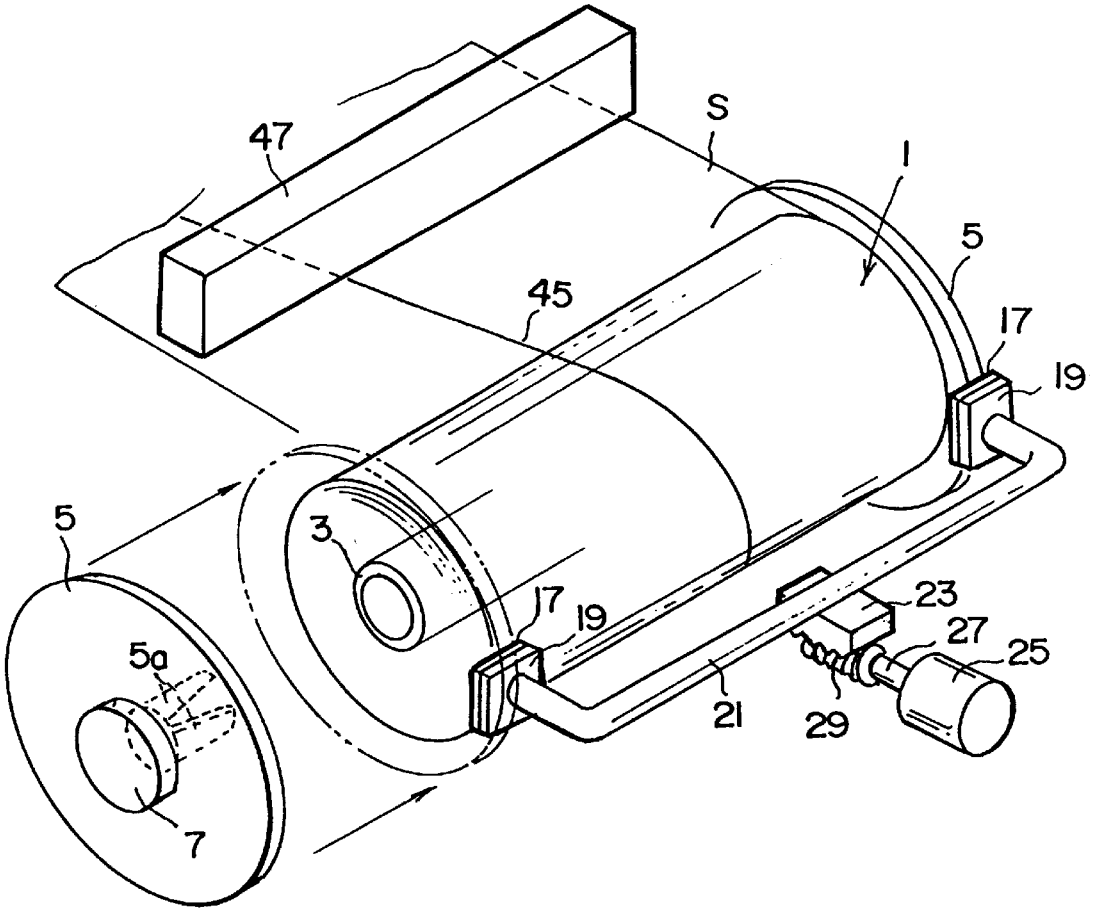
FIG. 7 is a view similar to FIG. 2 showing an alternate embodiment of the present invention using a marker which is different from that used in the first embodiment.
Figure 8:
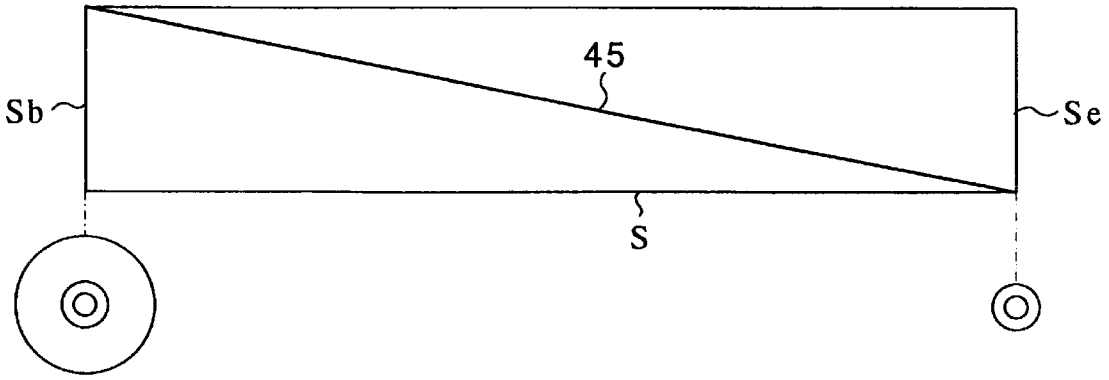
FIG. 8 is a view similar to FIG. 3 showing the marker printed on the sheet for detecting the outer diameter of the sheet roll.

In the above described embodiment, the stencil master plate sheet S was divided into eight segments along its lengthwise direction, and a different resistance torque was assigned to each of these segments, but the number of segments can be freely selected according to the allowable range of fluctuation in the tension. To the end of improving the detection capability of the sensor for detecting the outer radius or the diameter of the sheet roll 1, it is also possible to draw a diagonal line 45 between its leading edge Sb to trailing edge Se as illustrated in FIGS. 7 and 8, and detect the position of the stencil master plate sheet S by using a linear position sensor 47, a linear image sensor or the like for detecting the lateral position of the diagonal line at each of the lengthwise positions. When such a structure is employed, it is possible to control the tension of the stencil master plate sheet S in a continuous manner.

The rotational resistance could be applied to the sheet roll in a number of ways beside from those depending on friction. For instance, among other possibilities, viscous damping, fluid flow resistance, electromagnetic force can be used for the same purpose.

The use of the coded marker printed on the stencil master plate sheet is given only as an example, and it is also possible to directly measure the outer diameter of the sheet roll by suitable means.

As can be understood from the above disclosure, according to the sheet pay-out device according to the present invention, the outer diameter or the outer radius of the sheet roll is detected while the sheet is being paid out therefrom, and the rotational resistance intentionally applied to the sheet roll is reduced as the outer diameter or the outer radius of the sheet roll diminishes. Thus, the tension of the sheet can be maintained at a desired level irrespective of the change in the outer diameter of the sheet roll, and feeding of the sheet can be accomplished smoothly without involving any slackening, creasing or extending of the sheet.

By using a marker printed on the stencil master plate sheet, the detection of the outer diameter of the sheet roll can be simply and accurately carried out. Even when the sheet roll is changed and replaced by a new one, the present invention allows the control based on the detection of the outer diameter of the sheet roll to be carried out without requiring any resetting or readjustment of the control system.

Although the present invention has been described in terms of specific embodiments, it is possible to modify and alter details thereof without departing from the spirit of the present invention.

What is claimed is:

1. A stencil master plate sheet pay-out device for paying out a stencil master plate sheet from a sheet roll, said stencil master plate sheet carrying thereon information indicative of the outer diameter of said sheet roll, said device comprising:

support means for rotatably supporting said sheet roll of said stencil master plate sheet;

rotational resistance applying means for applying a variable resistance to a rotation of said sheet roll of said stencil master plate sheet;

reading means for reading said outer diameter information carried on said stencil master plate sheet paid out from said sheet roll; and control means for changing said variable resistance according to a change in said outer diameter information of said sheet roll read by said reading means.

2. A stencil master plate sheet pay-out device according to claim 1, wherein said reading means reads a current outer diameter information carried on said stencil master plate sheet paid out from said sheet roll, and said control means changes said variable resistance according to a change in said current outer diameter information of said sheet roll read by said reading means.

3. A stencil master plate sheet pay-out device according to claim 1, wherein said stencil master plate sheet includes a part carrying coded information on said outer diameter of said sheet roll when said part is located on an outer surface of said sheet roll, and said reading means consists of optical reading means for optically reading said coded information.

4. A stencil master plate sheet pay-out device according to claim 3, wherein said stencil master plate sheet includes a part carrying coded information on said outer diameter of said sheet roll which is indicative of said current outer diameter when said part is located on an outer surface of said sheet roll.

5. A stencil master plate sheet pay-out device according to claim 3, wherein said coded information is given by a plurality of lengthwise parallel lines which are selectively printed along laterally different positions on said stencil master plate sheet.

6. A stencil master plate sheet pay-out device according to claim 1, wherein said variable resistance is changed according to a change in said outer diameter of said sheet roll so as to maintain a tension at a substantially constant level in said stencil master plate sheet paid out by a platen roller.

7. A stencil master plate sheet roll comprising a roll of sheet, said stencil master plate sheet carrying thereon coded information of said stencil master plate sheet roll wherein said information is given by a plurality of lengthwise parallel lines which are selectively printed along laterally different positions on said stencil master plate sheet roll.

8. A stencil master plate sheet pay-out device for paying out a stencil master plate sheet from a sheet roll wherein said stencil master plate sheet carries thereon information indicative of the outer diameter of said sheet roll, said device comprising:

support means for rotatably supporting said sheet roll of said stencil master plate sheet;

rotational resistance applying means for applying a variable resistance to a rotation of said sheet roll of said stencil master plate sheet;

a plurality of photo electric sensors radially spaced from said sheet roll for sensing said information carried on said stencil master plate sheet indicative of the outer diameter of said sheet roll; and a resistance torque control unit for changing said variable resistance according to signals supplied from said plurality of photoelectric sensors indicative of the outer diameter of said sheet roll.

9. A stencil master plate sheet roll according to claim 8, further including a pad pressure sensor and a motor drive circuit and wherein said resistance torque control unit controls said motor drive circuit based upon feedback supplied from said pad pressure sensor.

10. A stencil master plate sheet pay-out device according to claim 9, wherein said photo electric sensors read the current outer diameter information carried on said stencil master plate sheet paid out from said sheet roll, and said torque control unit changes said variable resistance according to a change in said current outer diameter information of said sheet roll based upon information supplied by said photo electric sensors.

11. A stencil master plate sheet pay-out device according to claim 9, wherein said stencil master plate sheet includes a part carrying coded information on said outer diameter of said sheet roll when said part is located on an outer surface of said sheet roll.

12. A stencil master plate sheet pay-out device according to claim 11, wherein said stencil master plate sheet includes a part carrying coded information on said outer diameter of said sheet roll which is indicative of said current outer diameter when said part is located on an outer surface of said sheet roll.

13. A stencil master plate sheet pay-out device according to claim 11, wherein said coded information is given by a plurality of lengthwise parallel lines which are selectively printed along laterally different positions on said stencil master plate sheet.

14. A stencil master plate sheet pay-out device according to claim 9, wherein said variable resistance is changed according to a change in said outer diameter of said sheet roil so as to maintain a tension at a substantially constant level in said stencil master plate sheet paid out by a platen roller.

* * * * *